United States Patent [19]

Matzagg et al.

[11] Patent Number: 4,730,537

[45] Date of Patent: Mar. 15, 1988

[54] FIRING PIN SAFETY LOCK FOR AN AUTOMATIC FIREARM

[75] Inventors: Erich Matzagg, Overndorf-Bettendorf; Gerhard Bilger, Lauterbach; Helmut Mäder, Schramberg, all of Fed. Rep. of Germany

[73] Assignee: Mauser-Werke Oberndorf GmbH, Fed. Rep. of Germany

[21] Appl. No.: 931,739

[22] Filed: Nov. 17, 1986

[30] Foreign Application Priority Data

Nov. 22, 1985 [DE] Fed. Rep. of Germany ..... 3541311

[51] Int. Cl.[4] ..... F41D 11/00

[52] U.S. Cl. ..... 89/148; 42/70.08

[58] Field of Search ..... 42/70.08; 89/27.12, 89/148, 190

[56] References Cited

U.S. PATENT DOCUMENTS

| | | | |
|---|---|---|---|
| 2,382,410 | 8/1945 | Garand | 89/148 |
| 2,762,267 | 9/1956 | Persson et al. | 89/148 |
| 3,821,920 | 7/1974 | Brieger | 89/190 |

FOREIGN PATENT DOCUMENTS 644947 8/1984 Switzerland .

*Primary Examiner*—Stephen C. Bentley

*Attorney, Agent, or Firm*—McGlew and Tuttle

[57] ABSTRACT

A detonator lock on an automatic firearm, with a breech mechanism which is displaceable from a rear position into a priming position, comprises a safety device which can be pushed into the path of the closing device and is operatively connected with the support piece of the detonator. The safety device can be rigidly barred by a spring-supported lock bolt, the lock bolt which is held in position by a control element which is inserted in the path of the safety device before the safety device has moved into either the secured or the priming position.

5 Claims, 6 Drawing Figures

FIG. 3
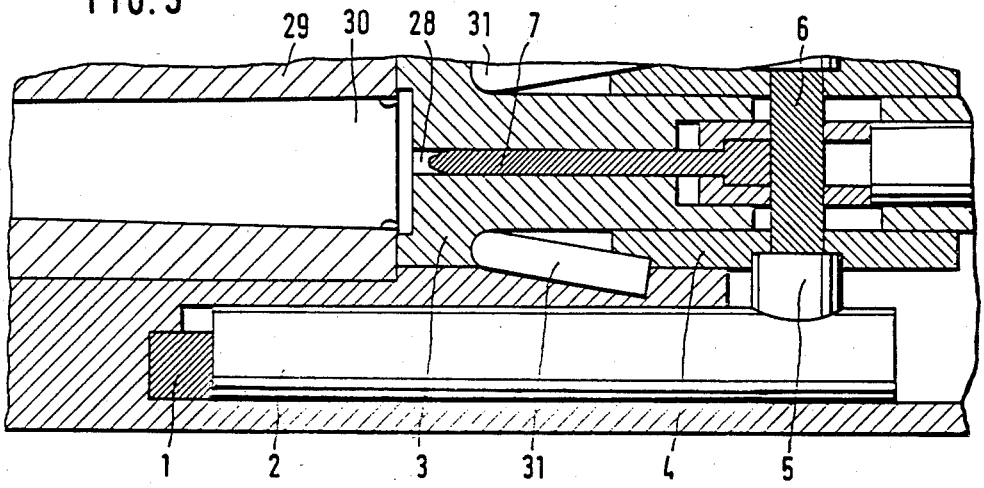
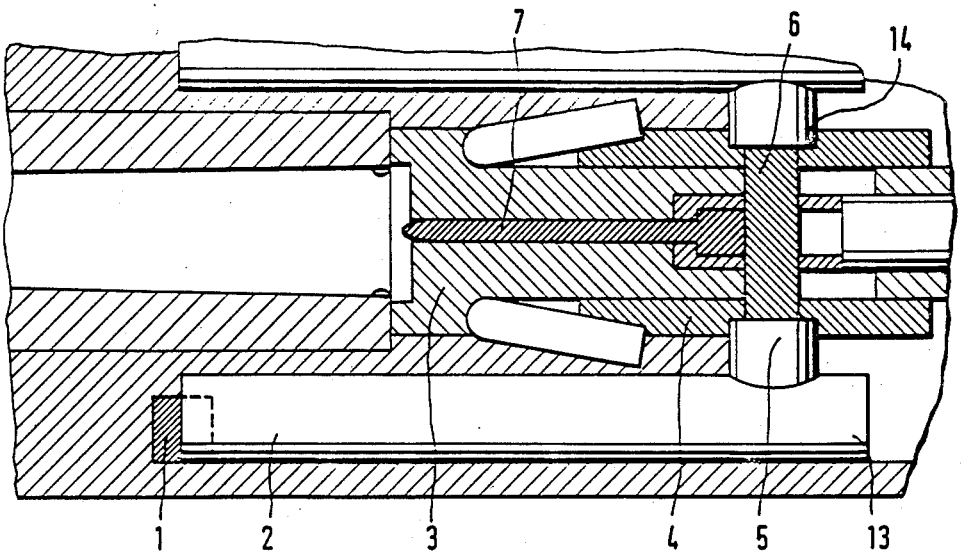
FIG. 6

FIRING PIN SAFETY LOCK FOR AN AUTOMATIC FIREARM

FIELD AND BACKGROUND OF THE INVENTION

This invention relates in general to firearms and in particular to a new and useful firing pin safety lock for an automatic firearm.

The invention relates to a firing pin safety lock on an automatic firearm, in particular a rapid fire cannon, with a breech mechanism movable from a rear position into a priming position, the firing pin being movable in the breech mechanism by a support piece into a secured and into a released position, and the support piece being in operative connection with a locking element.

From Swiss Pat. No. 644,947 an anti-priming device in an automatic firearm is known, which prevents unintended firing of a shot if something is wrong with the weapon. In it, a breech mechanism movable in the breech mechanism housing from a rear position to an igniting position is selectively secured in a position before its igniting position. For this purpose, there is employed in the known anti-priming device a pivotable locking element which cooperates with a spring. Depending on the position of the locking element assumed through pivoting, a lug engages in a control piece and prevents it together with the connected primer from moving forward in the direction of the cartridge chamber. This known anti-priming device is relatively expensive because special drive means are required for the pivoting of the locking element.

If is perfectly well known that in automatic firearms malfunctions may occasionally occur due to breakage of a part, dirt accumulation, or loss of closing spring force.

By such malfunctions the breech mechanism is prevented from reaching its frontmost position, namely the priming position. Now if malfunction due to external action, as for instance shock or vibration in transport or due to manipulation of the weapon, to correct the malfunction, the impediment of the breech mechanism is removed. The feed process is interrupted by the malfunction and it may be carried to its end in an uncontrolled manner and may even ignite the cartridge contained in the cartridge chamber. This leads to great danger to the operator and to the environment of the firearm.

SUMMARY OF THE INVENTION

The invention provides a firing pin safety lock on an automatic firearm which prevents the disadvantages described and can be realized with simple means in a manner not susceptible to malfunction.

According to the invention, the locking element is a safety device which can be pushed into the path of the closing device, e.g. a closing spring sleeve, operatively connected with the support piece of the firing pin and can be rigidly barred by a spring supported lock bolt, which is held in position by a control element inserted in the safety device before the safety device has moved into the secured position or into the priming position.

In the region of its rear end, the closing device may have a rectangularly projecting lug which engages positively in a cutout of the latch, which in turn is connected positively with the carrier piece of the firing pin. Further the safety device may be provided, at its end piece toward the closing device, with a bevel which, over a partial distance of the vertical movement of the safety device, corresponds with an approach bevel on an end face of the closing device.

In further development of the invention, the safety device may be formed, forked in its upper region with an inside groove, into which the control element is inserted. The control element may have a slot through which a bolt mounted in the arms of the fork of the safety device is passed and which limits the vertical movement of the control element. In addition, the control element may have coaxially with the slot a bearing bore in which rests a bolt of the safety lever which is rotatable about the end point of a lever arm directed rearwardly to the breech mechanism, in a cutout of the housing. The safety lever can slide along in a rail of the weapon cradle, whereby it can be secured independently of the position of the weapon.

In a still further development of the invention, the locking bolt is inserted in a blind hole in the housing and has a sleeve-like form at its inner end. A compression spring protrudes into the sleeve-like end and takes support against the end of the blind hole. The front end of the lock bolt is conical and is in engagement with two oppositely directed approach bevels of the control element and engages in corresponding grooves of the safety device and is disposed in the upper and lower end positions of the displacement path of the safety device.

According to the features of the invention, the safety device is pushed into the path of the closing device, e.g. a closing spring sleeve, in such a way that upon advance of the breech mechanism the latch, which is coupled with the closing device via the lug, and hence also the striking pin coupled with the latch via the wedge, does not reach its end position and prevents ignition of the supplied cartridge. The safety device mounted in the weapon housing is formed so that, in a secured position and in released position, it is rigidly locked by a spring supported bolt, to prevent the lock moving unintentially due to shocks or vibrations when firing.

As a further advantage of the features according to the invention, it must be regarded that also a separate movement for the actuation of the latch bolt is achieved. For this purpose, in fact, there is introduced into the safety device a control element which, without interrupting the movement of the safety lever, pushes the safety device into the secured or the released position. This control element maintains its function also if the safety device is moved directly or through another element. As a whole, with the aid of this lock according to the invention, a burst of fire can be interrupted if due to a malfunction this would not be possible any more with the trigger mechanism provided therefor.

Accordingly, it is an object of the invention to provide an improved firing pin safety lock which includes a locking member which may be selectively movable into and out of engagement with a closing device so that it either can be released to move a support piece to move a firing pin to fire a cartridge or be blocked from some moving in a safety position.

A further object of the invention is to provide a firing pin safety lock for a firearm which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 3 is a longitudinal section through the fuse lock of an automatic firearm having the invention taken along line III—III of FIG. 1;

FIG. 6 is a longitudinal section through the firearm with the firing pin safety lock according to the invention along line VI—VI of FIG. 4.

DESCRIPTION OF THE PREFERRED EMBODIMENTS

Figure 1:
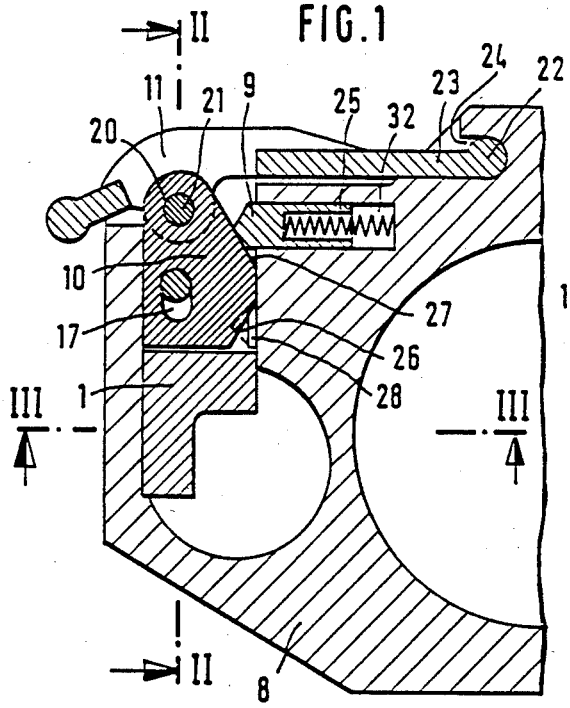
FIG. 1 is a transverse sectional view through a firing pin safety lock shown in secured position; and constructed in accordance with the invention.
Figure 2:
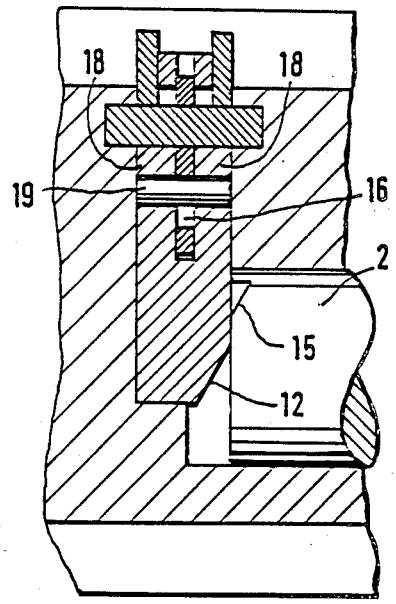
FIG. 2 is a section through the firing pin safety lock along the line II—II of FIG. 1.
Figure 4:
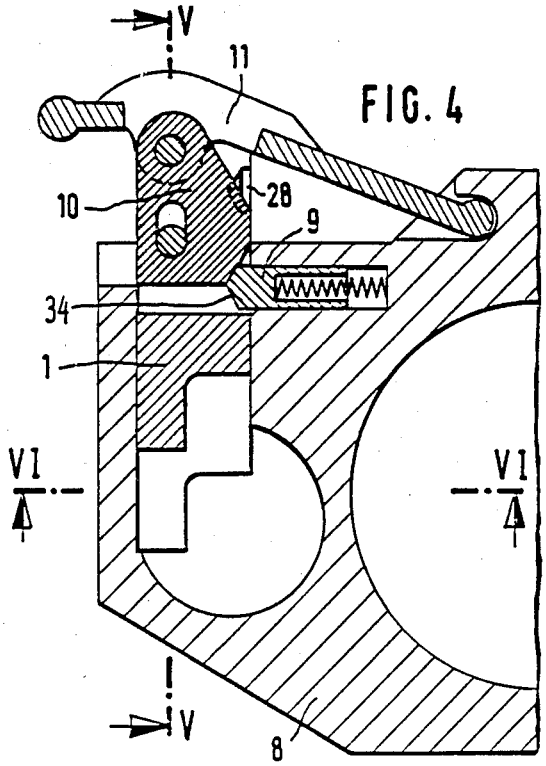
FIG. 4 is a transverse section similar to FIG. 1, but in the igniting position.
Figure 5:
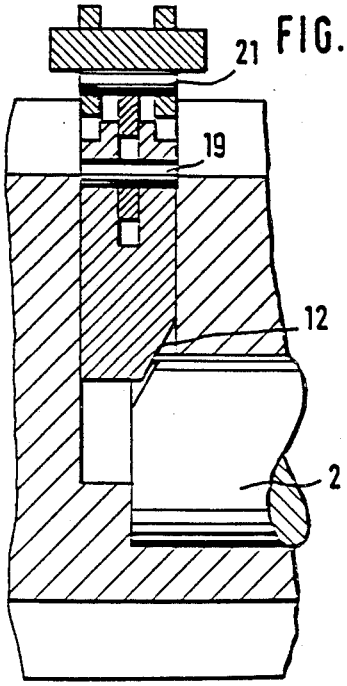
FIG. 5 is a section through the detonator lock taken along line V—V of FIG. 4.

Referring to the drawings in particular the invention embodied therein comprises a firing pin safety lock which includes a locking element or safety device 1 arranged to either lock or release a closing device 2 which carries a support piece 6 which is movable with the closing device 2 to move a firing pin 7 to a position in which it fires a cartridge positioned in a cartridge chamber 30.

The firing pin safety lock according to the invention is illustrated in a firearm such as an automatic rapid fire cannon and shows according to the figures a breech mechanism 3, which can be displaced from a rear position forward into an igniting position. In the breech mechanism 3, the firing pin 7 is inserted in a central bore for lengthwise displacement. The bore 28 for the firing pin 7 leads into the cartridge chamber 30 of the barrel 29. In the breech mechanism 3 are provided further support flaps 31, which are in connection with the latch 4 of the breech mechanism 3. Now the latch 4 has a shaped groove into which a lug 5 of the closing device 2 engages positively. In this example the closing device is formed as a closing spring sleeve.

A support piece 6 engaging in additional cutouts of the latch 4 is connected with the rear end of the firing pin 7 in such a way that an axial movement of the closing spring sleeve 2 parallel to the barrel 29 leads to a reciprocating movement of the firing pin 7.

At the front end face of the closing spring sleeve 2 there engages a safety device or locking element 1. This locking element 1 is designed as a safety device and is formed at the top forked with an inner groove 16. The bottom part, which is turned toward the end face of the closing spring sleeve 2, has an approach bevel 12, which corresponds with a bevel 15 of the closing spring sleeve.

In the groove 16 of the safety device 1 is a control element 10 with a slot 17 through which a bolt 19 is passed which mounted in the arms 18 of the forked part of the safety device 1. Above the bolt 19 and on the same vertical axis is an additional bolt 21 in a bearing bore 20, the bearing bolt 21 receiving a safety lever 11, which pivots about its rear point of a lever arm portion 23 in a cutout 24 of the housing. The control element 10 is equipped with two oppositely directed approach bevels 26 and 27 which are alternately in engagement with a latch bolt 9. The latch bolt 9 is inserted in a blind hole 32 of the weapon casing 8 and has in the rear portion a sleeve like form into which there projects a compression spring 25 which braces itself against the inner end of the blind hole 32. The front end of latch bolt 9, protruding from the blind hole 32, is conical and is in engagement with the approach bevels 26 and 27 of the control element 10, and also the conical end of the latch bolt 9 engages in matching grooves 34 of the safety device 1 which are disposed in the upper and in the lower end position of the displacement path of the safety device 1.

As a result of the aforementioned construction according to the invention, the safety device 1 is pushed into the path of the closing spring sleeve 2 in such a way that, as the breech mechanism 3 advances, the latch 4, which (is coupled) with the closing spring sleeve 2 via the lug 5, and hence the firing pin 7 coupled with it via the support piece 6, does not reach its end position and absolutely prevents ignition of the supplied cartridge. The safety device 1 mounted in the weapon casing 8 is designed so that it is rigidly locked by the spring supported latch bolt 9 in the secured and in the released position. It is thereby prevented that the lock moves unintentionally due to impacts or vibrations when firing.

To avoid a separate movement for the actuation of the latch bolt 9, there is inserted in the safety device 1 the control element 10 which, without interrupting the movement of the safety lever, brings the latch bolt 9 out of engagement before the safety lever 11 pushes the safety device 1 into the position "secured" or "released".

This control element 10 maintains its function also when the safety device 1 is moved directly or by another element. The actuation of the safety device 1 via the safety lever 11 occurs as a rule via a rail (not shown here), in the cradle of the weapon, in which the safety lever 11 is guided for longitudinal movement.

At its end 12 toward the closing device 2, the safety device 1 is formed with an approach bevel, so that it is able to push the closing spring sleeve 2 out of its forward ignition position back into the rear, secured position. This is necessary e.g. for ignition failures or similar malfunctions.

With the aid of the lock also a burst of fire can be interrupted if this is no longer possible with the trigger mechanism of the firearm provided therefore, due to a malfunction.

While specific embodiments of the invention have been shown and described in detail to illustrate the application of the principles of the invention, it will be understood that the invention may be embodied otherwise without departing from such principles.

What is claimed is:

1. In an automatic firearm including a casing, a breech mechanism in said casing, a firing pin movable from an inactive position to a priming position, a cartridge chamber and a closing device adapted to move said firing pin between said inactive position and said priming position for engaging a cartridge loaded into said cartridge chamber; a firing pin safety lock comprising, in combination; a locking element mounted in said casing and movable between a blocking position prohibiting movement of said closing device and a release position allowing free movement of said closing device, said locking element comprising an upper portion with a forked part defining an interior groove, a control element inserted within said groove and affixed to said locking element, an actuator mechanism operatively associated with said locking element for moving said locking element to a selected one of said blocking or release positions, a latch bolt slideably mounted inside a blind hole provided within said casing adjacent to said forked part of said locking element, said latch bolt having an inner sleeve end portion facing the inside of said blind hole, a compression spring mounted inside said latch bolt and protruding from said inner sleeve end portion, said compression spring engaging the inside of said blind hole at one end thereof and at the other end biasing said latch bolt outwardly in a direction toward said forked part of said locking element, said latch bolt having a conical end which is adapted to seat inside one of two matching grooves provided on said locking element within said forked part thereof for restraining movement of said locking element when placed in either of said blocking or release positions, said control element having oppositely inclined approach bevels on its surface facing the conical end of said latch bolt for disengaging said latch bolt when moved in either direction by said actuator mechanism.

2. An automatic firearm according to claim 1, wherein said closing device has a rear portion with a rectangularly projecting lug and wherein said firearm further includes a support piece affixed to said firing pin and a latch into which said projecting lug extends so that said latch is positively connected with said support piece.

3. An automatic firearm according to claim 1, wherein said locking element has a side facing said closing device with a bevel, said closing device having an approach bevel which over a partial distance of its vertical movement corresponds with said bevel of said closing device.

4. An automatic firearm according to claim 1, wherein said control element has a slot including a bolt extending through said slot and mounted on said locking element and limiting the movement of said control element.

5. An automatic firearm according to claim 4, wherein said control element has a bearing bore in parallel alignment with said slot and wherein said actuator mechanism includes a safety lever pivotally mounted on said casing and engaged with a bolt extending through said bearing bore and having a rear end portion pivotally supported in a cutout of said casing.

* * * * *